United States Patent [19]

Forgey et al.

[11] 4,282,812

[45] Aug. 11, 1981

[54] FIELD-PRIMABLE CHUB CARTRIDGE HAVING A LONGITUDINAL THREADING TUNNEL INTEGRAL THEREWITH

[75] Inventors: James H. Forgey, Martinsburg, W. Va.; Donald R. Stephens, Wilmington, Del.; Engnam A. Tan, Hagerstown, Md.

[73] Assignee: E. I. Du Pont de Nemours & Company, Wilmington, Del.

[21] Appl. No.: 27,882

[22] Filed: Apr. 6, 1979

[51] Int. Cl.[3] ..... C06C 11/00

[52] U.S. Cl. ..... 102/318; 102/320; 102/322; 102/324

[58] Field of Search ..... 102/24 R, 21, 21.6, 102/22 R, 32

[56] References Cited

U.S. PATENT DOCUMENTS

| | | | |
|---|---|---|---|
| 1,512,714 | 10/1924 | Saucier . | |
| 2,171,384 | 8/1939 | Young | 102/24 R |
| 2,969,101 | 1/1961 | White | 102/24 R X |
| 3,150,590 | 9/1964 | Silverman | 102/21.6 |
| 3,332,349 | 7/1967 | Schwoyer et al. | 102/24 R X |
| 3,339,705 | 10/1967 | Wilson . | |
| 3,534,685 | 10/1970 | Romocki et al. | 102/24 R |
| 3,731,625 | 5/1973 | Slawinski | 102/24 R |
| 3,783,787 | 1/1974 | Thornley et al. | 102/24 R |
| 3,789,760 | 2/1974 | Griffith . | |
| 3,795,081 | 3/1974 | Brown et al. . | |
| 3,861,522 | 1/1975 | Llewellyn et al. . | |
| 3,874,461 | 4/1975 | Cocanower | 102/20 X |
| 3,918,235 | 11/1975 | Brown et al. . | |
| 3,992,854 | 11/1976 | Howell et al. . | |
| 4,009,778 | 3/1977 | Howell . | |
| 4,023,494 | 5/1977 | Barton et al. . | |
| 4,037,536 | 7/1977 | Griffith | 102/20 X |
| 4,052,939 | 10/1977 | Simmons et al. | 102/24 R |
| 4,103,473 | 8/1978 | Bast et al. . | |
| 4,205,611 | 6/1980 | Slawinski | 102/24 R |

*Primary Examiner*—Peter A. Nelson

*Attorney, Agent, or Firm*—Diamond C. Ascani

[57] ABSTRACT

A chub cartridge has a tubular chamber containing a water-bearing blasting agent, and a longitudinal tunnel adjacent to the tubular chamber and integral therewith. Preferably, the tunnel is full-length and continuous and has holes for threading a detonating cord therethrough and for holding a cord firmly against the tubular chamber for the cord-priming of the cartridges. In primer assemblies, the tunnel also can be used to hold a cap/-booster in place, and for lacing cap wires or a low-energy detonating cord. A preferred cartridge is made continuously in a series by wrapping a web of film having a row of holes along one edge so as to form a tube and an outer flap containing the holes, and sealing the tube and the flap so as to form a tunnel containing the holes in its outer portion, the wrapping being performed so that either the inner or outer portion of the tunnel is circumferentially longer than the other.

26 Claims, 16 Drawing Figures

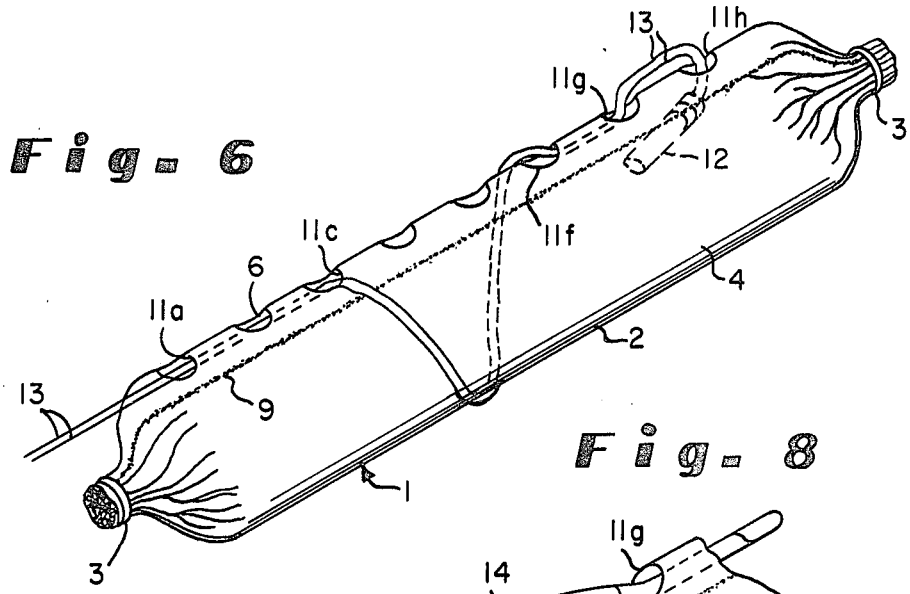
Fig. 6
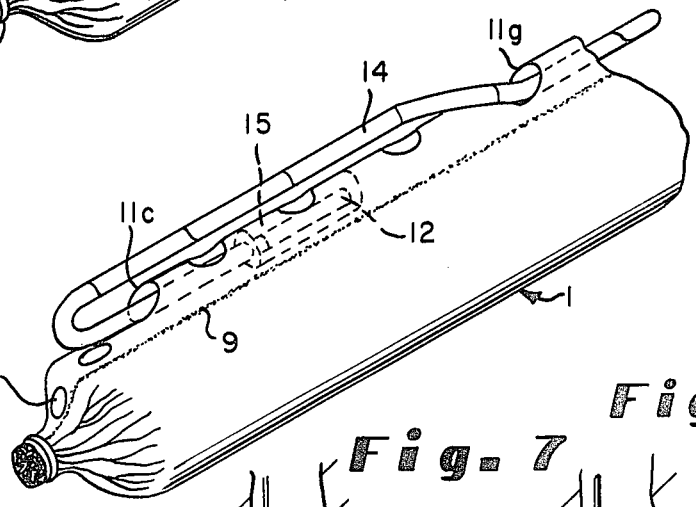
Fig. 8
Fig. 9
Fig. 7
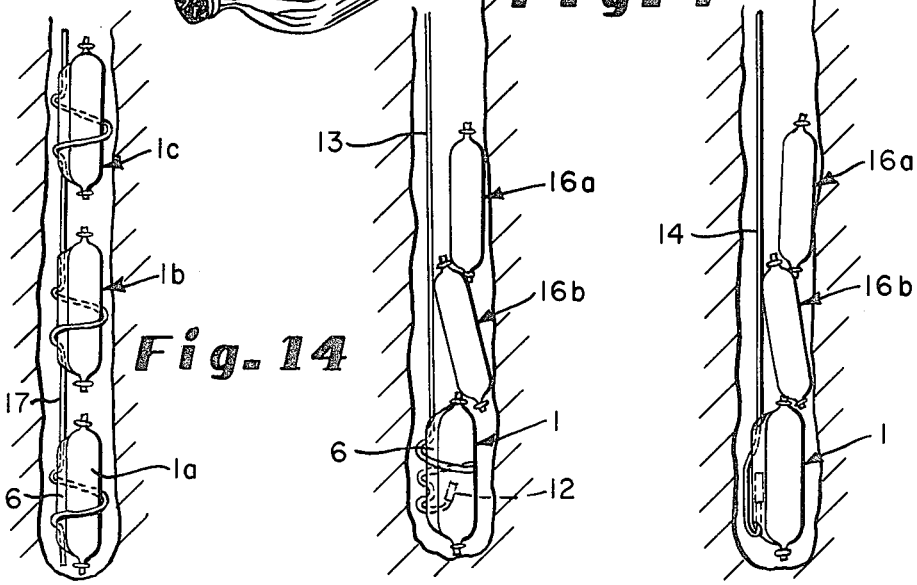
Fig. 14

FIELD-PRIMABLE CHUB CARTRIDGE HAVING A LONGITUDINAL THREADING TUNNEL INTEGRAL THEREWITH

BACKGROUND OF THE INVENTION

1. Field of the Invention

This invention relates to an improved film-wrapped blasting cartridge, particularly a chub cartridge containing a water-bearing blasting agent.

2. Description of the Prior Art

Semi-solid colloidal dispersions of water-bearing blasting agents, e.g., water gels or slurry explosives, or emulsion-type blasting agents, currently are available in the form of film-wrapped cartridges, often referred to as "chub" cartridges. The chub cartridge is a tube of plastic film, filled with blasting agent, and gathered at both ends and closed, e.g., by means of metal closure bands around the gathered portions.

Chub cartridges of water-bearing blasting agents which are used to initiate the detonation of adjacent non-cap-sensitive blasting agents in boreholes, e.g., adjacent chub cartridges or a detonable mixture of ammonium nitrate and fuel oil (ANFO), are known as primer cartridges, which are "primed" in the field by various techniques to form primer assemblies. Priming involves affixing to the chub cartridge an initiating means such as a detonating cord, an electric blasting cap, or an nonelectric blasting cap and detonating cord, any of which may, if necessary or desirable, be positioned in initiating relationship with the cartridged blasting agent via a small tubular booster to form the primer assembly.

According to present practice, for example, a chub cartridge of a cap-sensitive blasting agent can be primed by punching a hole in the side or end of the cartridge, inserting an electric blasting cap into the blasting agent, and tying one or two half-hitches, depending on cartridge diameter, around the cartridge with the cap leg wires to support the cartridge weight during loading and to hold the cap in position. A chub cartridge of cap-sensitive blasting agent can also be primed by a 4.5 gram/meter or larger detonating cord placed inside, or along the outside of, the cartridge. This is presently accomplished by punching holes in opposite sides of the cartridge, threading the cord through the cartridge, and knotting the cord outside the cartridge; or by taping the cord along the outside of the cartridge.

For use with non-cap-sensitive blasting agents, the blasting cap or detonating cord that is to initiate the detonation of the blasting agent in the chub cartridge is supplemented by a small cap-sensitive booster, e.g., a mixture of pentaerythritol tetra-nitrate and an elastomeric binder extruded in the form of a tube, which is placed around the blasting cap or detonating cord before insertion into the blasting agent.

The described techniques of priming chub cartridges of blasting agents suffer from certain drawbacks. First, with certain blasing compositions and packaging films, the punching of one or more holes in the film introduces the possibility that the composition might to some extent become desensitized by water in wet boreholes. Naturally, it would be advantageous to eliminate the need to punch holes in the cartridge where possible, especially if the package film is one which readily propagates a tear, or if the blasting composition is subject to desensitization by water. Secondly, the tying of half hitches around cartridges is time-consuming and bothersome. Thirdly, the taping of cord to the cartridges also is time-consuming and, more importantly, could lead to failure if the taping should fail to provide the necessary intimate contact between the cord and cartridge along substantially the entire length of the cartridge.

In some methods of blasting, explosive cartridges are loaded in a borehole in a manner such that there is a spacing between their ends filled with an inert material (e.g., as in smooth blasting or trenching), or with a less-sensitive blasting agent that is to be detonated by the detonation of the spaced cartridges (e.g., to initiate ANFO compositions). In certain situations in which it is desired to position the cartridges end-to-end, such positioning can be destroyed by the collapse of the borehole. In all such cases in which the propagation of a detonation between cartridges cannot be assured, each cartridge has to be primed, and with chub cartridges this has usually been done by taping each cartridge onto a common detonating-cord downline. This procedure is time-consuming and, as mentioned previously, can fail to provide the required contact between cord and cartridge.

Rigid explosive containers such as metal or plastic cans have heretofore been adapted to have detonating cord held in place along their periphery by the application of a sleeve or cartridge coupler to the container. For example, U.S. Pat. No. 3,332,349 describes a rigid, continuous explosive column of cartridges joined end-to-end by couplers with a detonating cord threaded between the walls of the cartridge and surrounding couplers. U.S. Pat. No. 3,789,760 describes a primer can and a sleeve fitting around the can and cooperating therewith to form recesses adapted to receive a blasting cap or detonating cord for actuating the primer. Similar container/sleeve combinations are described in U.S. Pat. Nos. 4,023,494 and 4,037,536.

U.S. Pat. No. 1,512,714 describes a stick of explosive having a heavy paper wrapper or casing wherein a longitudinal passage or channel is formed for retaining safety fuse adjacent the side of the stick, the walls of the channel being of double thickness and strong enough to hold their shape during shipment and handling. One end of the fuse is connected to a blasting cap which fits into an axial hole in the stick, and the channel holds the fuse and cap against displacement by a direct longitudinal pull. The paper wrapper has flaps which fold down over the ends of the stick and have to be opened up temporarily to allow attachment of the cap and fuse.

SUMMARY OF THE INVENTION

This invention provides a chub blasting cartridge which is capable of being easily and securely primed in the field without the need of applying external cord-holding sleeves or couplers, or nullifying the end-closures of the cartridge or longitudinally immobilizing an adjacent cord as was required with the heretofore-known wrapped dynamite sticks.

The chub blasting cartridge of the invention comprises a generally cylindrical body of plastic film gathered and closed at both ends and containing a water-bearing blasting agent, the generally cylindrical body comprising a web of film wrapped about a longitudinal axis and sealed continuously in the direction of that axis to form a substantially tubular enclosure or chamber filled with the blasting agent, and a flap portion, the latter being sealed longitudinally to form a threading tunnel adjacent to the substantially tubular enclosure on an axis parallel to the latter's longitudinal axis, a portion of the wall of the tunnel being exposed to allow access to the tunnel without destroying the integrity of the sealed tubular enclosure.

In a preferred cartridge of the invention, the tunnel extends substantially the entire length of the cylindrical body, is continuous, and has at least two, and most preferably more than two, access apertures in the exposed portion of its wall.

The present invention also provides various primer assemblies containing the chub blasting cartridge of the invention wherein electric bearing cap wires, detonating cord, or a cap-booster assembly are present in the tunnel; and blasting assemblies wherein a primer assembly of the invention is positioned in a borehole for the "bottom-hole priming" of a column of chub cartridges, or wherein a continuous or discontinuous column of cartridges of the invention have a detonating cord threaded or laced through their aligned tunnels.

Also provided by this invention is a high-speed, continuous method of producing a series of preferred chub cartridges of the invention, the method comprising:

(a) wrapping a web of plastic film about a longitudinal axis so that one longitudinal edge overlaps the other, a continuous row of holes being present along the overlapping longitudinal edge, and one of the sections of film in the overlap region being constrained to move through a greater circumferential distance than the other in the wrapping;

(b) forming (1) a continuous linear seal between facing surfaces of the wrapped web so as to result in a tube and a flap portion outside the tube in the overlap region, the holes being present in the flap portion, and (2) a linear seal between facing film surfaces of the tube and the flap so as to form a tunnel adjacent to the tube on an axis parallel to the tube's longitudinal axis, the web being wrapped in a manner such that said tunnel has an exposed wall portion containing said holes in longitudinal array, and an inner wall portion, one of said wall portions being circumferentially longer than the other;

(c) feeding a water-bearing blasting agent into the tube;

(d) constricting the loaded tube and adjacent tunnel at spaced intervals;

(e) applying a pair of encircling closure means to the constricted areas; and (f) servering the tube and tunnel between the pair of closure means.

BRIEF DESCRIPTION OF THE DRAWING

In the accompanying drawing, which illustrates specific embodiments of the primable chub blasting cartridge, primer assemblies, and blasting assemblies of the invention, as well as of an apparatus that can be used in the method of the invention.

FIG. 6 is a perspective view of a primer assembly of the invention in which the cartridge shown in FIG. 1 is primed with an electric blasting cap immersed in the blasting agent in the cartridge;

FIG. 7 shows schematically a bottom-hole-primed blasting assembly employing the primer assembly shown in FIG. 6;

FIG. 8 is a perspective view of a primer assembly of the invention in which the cartridge shown in FIG. 1 is primed with a nonelectric blasting cap and booster in the tunnel;

FIG. 9 shows schematically a bottom-hole-primed blasting assembly employing the primer assembly shown in FIG. 8;

FIG. 14 shows schematically a blasting assembly of multiple spaced primed cartridges of the invention useful in pre-shearing;

DETAILED DESCRIPTION

Figure 1:
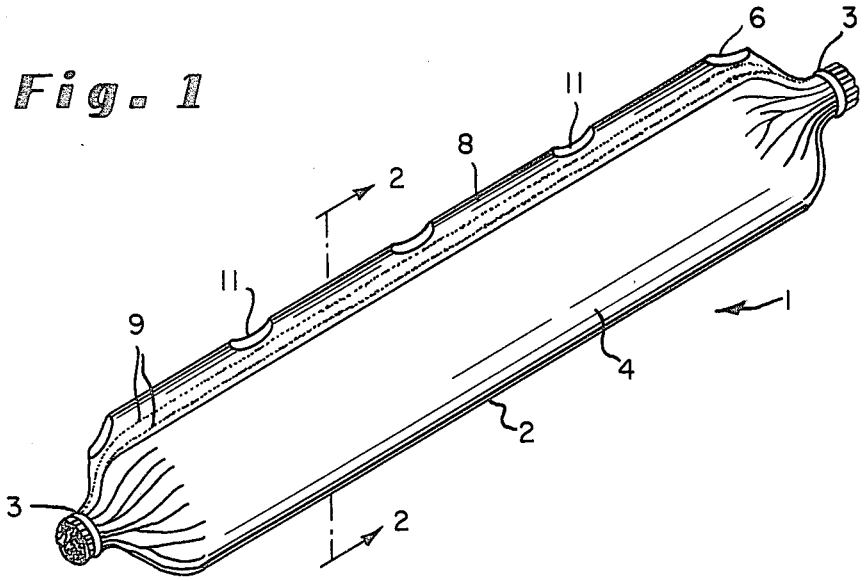
FIG. 1 is a perspective view of a preferred chub blasting cartridge of the invention.
Figure 2:
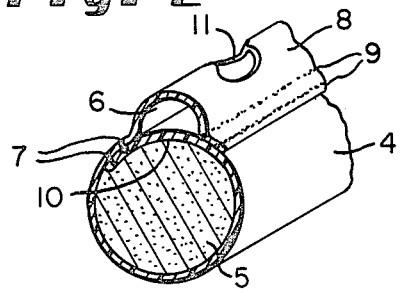
FIG. 2 is a cross-section taken along line 2—2 of the cartridge shown in FIG. 1.

With reference to the cartridge shown in perspective in FIG. 1 and in horizontal cross-section in FIG. 2, 1 is a chub cartridge comprising a generally cylindrical body 2 of plastic film gathered and closed at both ends as shown, being secured by clips 3. Cylindrical body 2 consists of a tubular enclosure 4, substantially circular in cross-section, filled with a water-bearing blasting agent 5, and an empty tunnel 6 adjacent to tubular enclosure 4 and integral therewith. The integral character of the filled tubular enclosure with the adjacent tunnel results from the fact that the cylindrical body comprises a web of film wrapped about a longitudinal axis (the axis of tubular enclosure 4) and sealed continuously at 7 in the direction of that axis to form the sealed tubular enclosure 4 and a flap portion 8, which is sealed continuously to the wall of the tubular enclosure at 9 to form tunnel 6, flap portion 8 thereby becoming an exposed portion of the wall of tunnel 6. In the integral structure, the inner portion 10 of the wall of tunnel 6 is formed by the portion of the wall of tubular enclosure 4 that is between seals 7 and 9. The latter are linear seals, each linear seal comprising, in this case, two linear polymeric beads.

A row of circular apertures or holes 11, substantially equally spaced, is provided in exposed portion 8 of tunnel 6. These afford access to the tunnel as well as a cord or wire looping and lacing capability.

In the cartridge shown in FIGS. 1 and 2, exposed portion 8 of tunnel 6 is longer (i.e., circumferentially) than inner portion 10, and tunnel 6 extends continuously for the entire length of cylindrical body 2. In this embodiment, therefore, cylindrical body 2 consists of a cylinder of circular cross-section (tubular enclosure 4) and an adjacent tunnel 6 outside the cylinder. This structure may be preferred to an internal tunnel if it is desired to slide cartridges down a detonating cord threaded in the tunnels therein.

Although the full-length continuous tunnel is preferred because it is more easily made on a continuous basis by the method of this invention, it is not necessary that the tunnel extend the full length of the cartridge so as to be a part of the gathered ends thereof as shown in FIG. 1. The tunnel need only be long enough to provide the desired type of cord or wire lacing or winding, or to keep a longitudinally positioned cord in contact with the wall of the tubular enclosure containing the blasting agent for substantially the entire length of the cartridge between the tapered-end portions thereof. In some cases, therefore, the ends of the tunnel may not extend as far as the tapered-end portions of the cartridge. Also, the tunnel may be discontinuous, e.g., by virtue of discontinuity in seal 9.

While it is not necessary that access apertures be present in exposed portion 8 of tunnel 6, inasmuch as slits can be made therein in the field, the apertures preferably are provided in the tunnel prior to the priming of the cartridge in the field, and most preferably prior to the formation of the cartridge, as this avoids possible damage to the tubular enclosure containing the blasting agent, and the troublesome interruption of the priming operation. Substantially circular holes are the preferred apertures because they require a smaller opening than slits to accommodate a given cord diameter, and because the stresses are not concentrated at a point during borehole loading as they are with slits. These features could be important to tunnel integrity with cartridge films that easily propagate tears.

The axial location of, and distance between, the two access apertures required in the tunnel wall for entry and exit of a cord or wires can vary. For example, the two apertures can be positioned one near each end of the tunnel, one nearer an end and the other nearer the center, or both near the center. They are sufficiently spaced apart that tunnel integrity is maintained between them under borehole loading conditions when threaded with cord. When the cartridge is to be primed with a detonating cord in its tunnel, it is desirable to hold a greater portion of the cord securely against the chamber containing the blasting agent when a less-energetic cord or less-sensitive blasting agent is used, and in such cases the two apertures preferably are on opposite sides of the center of the cartridge, each being axially spaced from the nearest cartridge end by a distance which is no greater than about one-fourth the length of the cartridge. More than two holes are preferred, as this allows a greater capability in lacing and looping of cord in the tunnel and around the cartridge. Usually a spacing between aperture centers of about from 25 to 76 millimeters will be convenient for ease of threading and handling, and will provide at least two apertures on cartridges of commonly used lengths.

Figure 3:
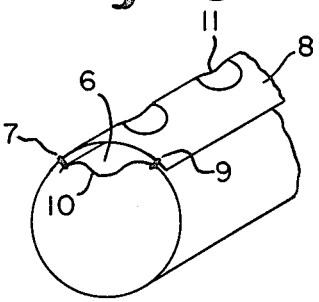
FIGS. 3, 4, and 5 are schematic representations of the horizontal cross-sections of three cartridges of the invention having a different tunnel structure from the cartridge shown in FIGS. 1 and 2.

In the embodiment depicted in FIG. 3, inner portion 10 of tunnel 6 is longer (i.e., circumferentially) than exposed portion 8, and this results in a cylindrical body 2 of substantially circular cross-section, tunnel 6 in this case being inside the circular cylinder.

Figure 5:
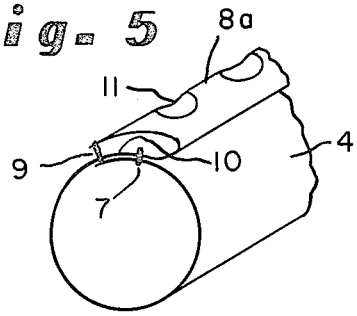
Figure 4:
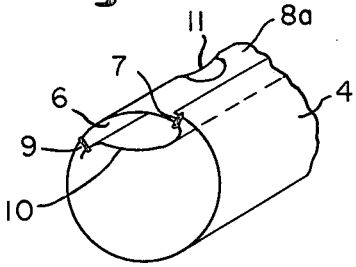

In the embodiments shown in FIGS. 4 and 5, the flap portion 8 which is formed when the web of film is wrapped and sealed continuously at 7 to form tubular enclosure 4 is folded so that a portion of it, 8*a*, becomes an exposed portion of the wall of tunnel 6, while the remainder forms the inner portion 10 of the wall of tunnel 6. The tunnel is formed by sealing the two portions of the folded flap together at 9. In the cartridge shown in FIG. 4, the inner flap portion between seals 7 and 9 forms a common wall, i.e., the inner wall 10 of tunnel 6 and a portion of the wall of tubular enclosure 4. In this case, as in the structure shown in FIG. 3, cylindrical body 2 is of substantially circular cross-section, and tunnel 6 is inside the circular cross-section.

In the cartridge shown in FIG. 5, the inner flap portion between seals 7 and 9 which results in inner tunnel wall 10, does not form a common wall between tunnel 6 and tubular enclosure 4, and, as in the case of the cartridge shown in FIGS. 1 and 2, tunnel 6 is adjacent to, but outside, the circular cylinder (tubular enclosure 4).

All of the cartridge structures shown in FIGS. 1 through 5 provide the improved field-priming capability that is attained with the chub cartridge of this invention, although certain structures are preferred over others on the basis that they are easier and cheaper to mass-produce, or better suited for certain borehole-loading procedures, as will be explained in the description of the priming and blasting assemblies, and cartridge manufacture.

The field-priming capability of the cartridge of the invention, and particularly the advantages afforded by the integral threading tunnel in this cartridge, will now be shown with reference to the primer and blasting assemblies of the invention shown in the drawing.

In FIG. 6, chub cartridge 1, described with reference to FIGS. 1 and 2, is shown primed with a blasting cap 12, in this case an electric blasting cap having lead wires 13, tunnel 6 being used to lace and loop wires 13 so that the cap/wire assembly can support the cartridge weight during loading into a borehole while the cap is maintained in position in the blasting composition 5 in tubular enclosure 4. To make this primer assembly in the field, the cap/wire assembly can be threaded (cap first) into a hole near one end of tunnel 6, in this case hole 11*a*, brought out of the tunnel through hole 11*c*, looped once around the cartridge, threaded in and out of holes 11*f* and 11*g*, respectively, and back in through hole 11*h*. Cap 12 is inserted into the cartridge by puncturing inner portion 10 of tunnel 6, the bottom end of the cap being turned in the direction of the wires emerging from hole 11*a*. In a similar manner, blasting cap 12 could be a nonelectric cap having its ignition charge in initiating relationship with a low-energy detonating cord (which would replace wires 13), and the cap/cord assembly could be laced and looped in the manner shown for the cap/wire assembly.

The primer assembly shown in FIG. 6 has the advantage over previous cap-primed chub cartridge assemblies that it is more easily and rapidly made because the need for half-hitches around the cartridges is eliminated.

FIG. 7 shows a blasting assembly in which the primer assembly of FIG. 6 is used to prime or initiate a column of chub cartridges of blasting agent at the bottom of the column in a vertical borehole. Cartridge 1 of the primer assembly is lowered into a hole by means of wires 13 (or low-energy detonating cord if cap 12 is nonelectric) with the bottom end of cap 12 directed toward the collar (top) of the hole. Unprimed chub cartridges 16*a*, 16*b*, etc. are then loaded above the primed cartridge. Cap 12 is actuated via the wires or cord, thereby causing the blasting agent in the cartridge to detonate. The remaining cartridges detonate by propagation of the detonation from one cartridge to another.

In FIG. 8, chub cartridge 1 is shown primed with a blasting cap 12, in this case a nonelectric blasting cap, located in tunnel 6. Low-energy detonating cord 14 is in initiating relationship to the ignition charge in blasting cap 12. Blasting cap 12 could, however, be an electric cap with lead wires 13 replacing cord 14. Cap 12 is seated in booster 15, which is a tube of cap-sensitive extruded plastic, e.g., a mixture of pentaerythritol tetranitrate (PETN) and an elastomeric binder. To make this primer assembly in the field, the cap/cord (or cap/wire) assembly can be threaded (cap first) into a hole near one end of tunnel 6 (entrance hole not shown) and brought out of the tunnel through hole 11*g*, booster 15 fitted onto cap 12, and cord 14 (or wires 13) bent back and the booster/cap/cord (or wire) assembly inserted into the tunnel through a hole near the end thereof opposite the entrance end, in this case hole 11*c*. Threading in this manner allows the cap/cord assembly to support the cartridge weight during loading into a borehole while the cap/cord is maintained in position in the tunnel. When contrasted to cap-primed chub cartridge assemblies wherein the cap is immersed in the blasting agent, thereby exposing the blasting agent to ambient conditions, such as water, via the hold required to insert the cap, which exposure could lead to the desensitization of the blasting agent, the primer assembly shown in FIG. 8 has the advantage that the blasting cap is easily positioned and held securely outside the blasting agent with no need to expose the latter to outside condition. At the same time, the initiation impulse from the laterally positioned blasting cap can be augmented by a booster, as shown, to assure reliable initiation of the blasting agent. Like the primer assembly shown in FIG. 6, this assembly also has the advantage that it is easily and rapidly made in that half-hitches are not required.

FIG. 9 shows a blasting assembly in which the primer assembly of FIG. 8 is used to prime or initiate a column of chub cartridges of blasting agent in the manner described for the blasting assembly of FIG. 7. In this case, cartridge 1 is shown lowered into a hole by means of cord 14 (but by wires 13 when cap 12 is electric) and, again, the bottom end of cap 12 is directed toward the collar of the hole. Low-energy detonating cord allows cartridge 1 to be detonated first inasmuch as the energy emitted from this cord is insufficient per se to cause cartridges 16*a*, 16*b*, etc. to detonate.

Figure 10:
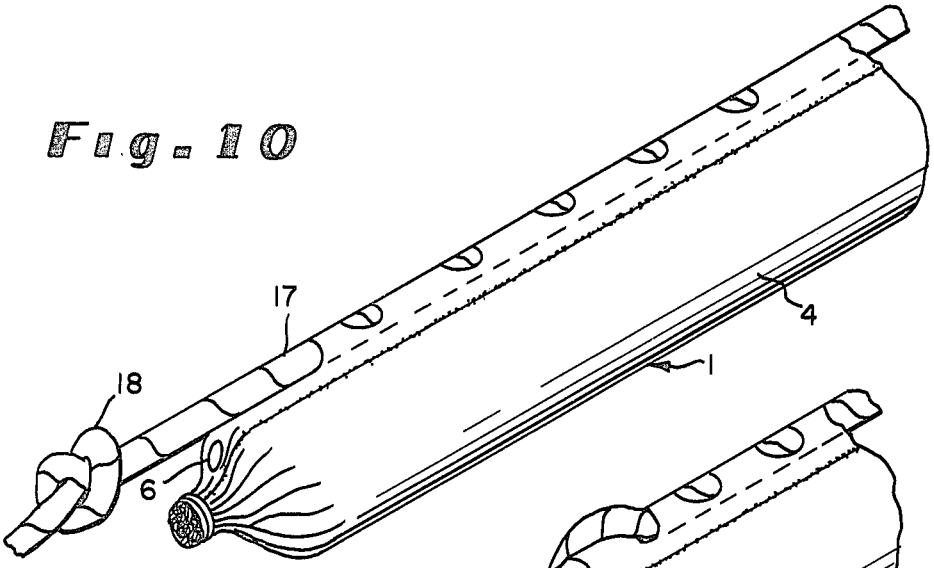
FIG. 10 is a perspective view of a primer assembly of the invention in which the cartridge shown in FIG. 1 is primed with a detonating cord threaded through its tunnel.
Figure 11:
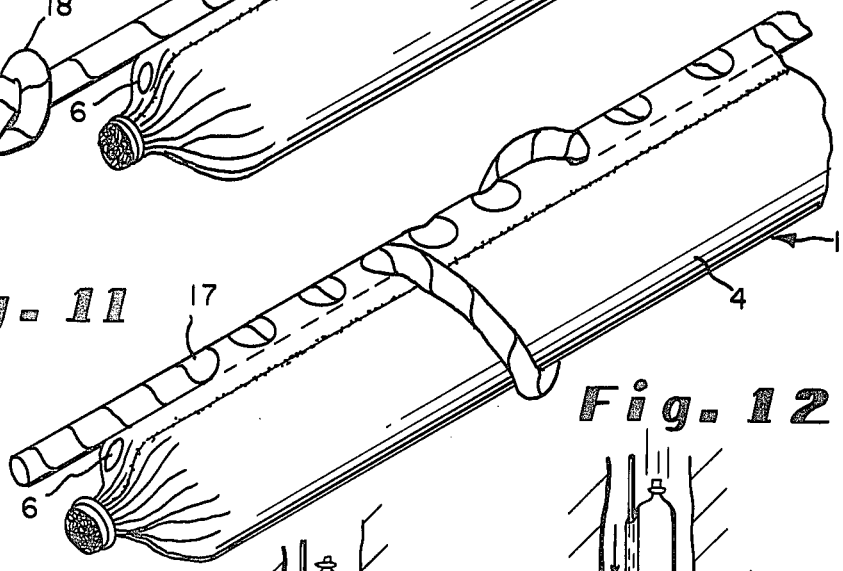
FIG. 11 is a perspective view of a primer assembly of the invention in which the cartridge shown in FIG. 1 is primed with a detonating cord threaded through its tunnel and wrapped around the cylindrical cartridge body.
Figure 12:
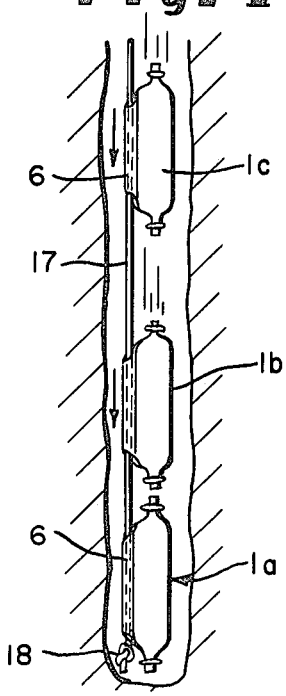
FIG. 12 is a schematic representation of the loading of a borehole with cartridges of the invention by sliding them down a common detonating cord threaded through the aligned tunnels of the cartridges.

In FIGS. 10 and 11, chub cartridge 1 is shown primed with a detonating cord, e.g., a cord having an explosive core loading of about 4.5 grams or more per meter of length, threaded through its tunnel. This primer assembly is used in conjunction with other cord-primed cartridges of this invention by threading a detonating cord through the aligned tunnels of each cartridge to produce a continuously primed blasting assembly. The first cartridge in the assembly can be kept from sliding off the cord by the means shown in FIG. 10 or 11. In FIG. 10, detonating cord 17 is threaded through tunnel 6, having entered through a hole (not shown) near one end of the tunnel and exiting from a hole near the opposite end. The end of cord 17 is provided with knot 18, which stops the cord from being pulled out of the tunnel when the cord/cartridge (1*a*) primer assembly is lowered to the bottom of a borehole as shown in FIG. 12. Other cartridges 1*b*, 1*c*, etc. can be strung on cord 17 after the first primer assembly by sliding them down the cord through their tunnels after the first assembly is in place at the bottom of the hole as is shown in FIG. 12; or all of the cartridges 1*a*, 1*b*, 1*c*, etc. can be pre-strung on cord 17 and the pre-strung assembly lowered into a hole. After placement in the hole, the cartridges shown in FIG. 12 would lie atop one another unless separated due to hole collapse. An advantage of the continuously primed assembly is that a continuous column of cartridges is not required to assure detonation of the column because the detonation of each cartridge is initiated by the detonation of the detonating cord adjacent thereto.

Figure 13:
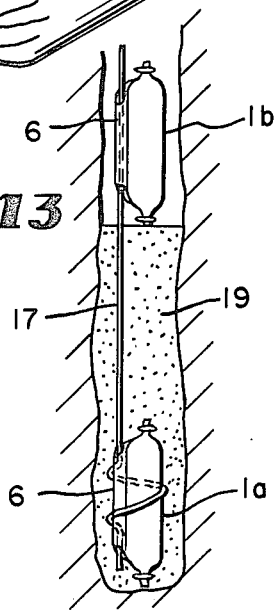
FIG. 13 is a schematic representation of an assembly of cord-threaded cartridges for priming a bulk blasting agent such as ANFO in a borehole.

In FIG. 11, detonating cord 17 is stopped from being pulled out of the cartridge tunnel by a loop between threaded portions. After insertion of the cord through a hole near one end, it is brought out of the tunnel and looped once around the cartridge near the center thereof, and thereafter the threading is repeated on the other side of the loop as shown. This cartridge/cord primer assembly is shown at the bottom of a borehole in FIG. 13. In the embodiment shown in FIG. 13, a discontinuous column of primed cartridges 1*a*, 1*b*, etc. is placed in a borehole to initiate a relatively insensitive blasting agent 19, e.g., a detonable mixture of ammonium nitrate and fuel oil (ANFO). After the first primed cartridge (1*a*) has been lowered in the borehole by cord 17, ANFO, for example, is loaded into the hole to a level at which it has been determined that a second primed cartridge should be used. At this point, a second cartridge (1*b*) is threaded onto cord 17, and the procedure is repeated until the hole is filled with a bulk ANFO charge containing a column of separated chub cartridges of the invention each primed with a common detonating cord threaded through the cartridge tunnel. The detonation of cord 17 causes each cartridge to detonate and prime the detonation of the ANFO.

FIG. 14 shows a column of spaced primed cartridges of the invention of the type shown in FIG. 11. In this assembly, the cord is threaded through and looped around each cartridge 1*a*, 1*b*, 1*c*, etc. to maintain a predetermined spacing between them as is required in certain methods of blasting, e.g., in pre-shearing. The cartridges would be pre-strung, lowered into the borehole, and cord 17 detonated, causing the cartridges to detonate.

The dimensions of the cartridge of the invention and of the component parts thereof, the specific spacing between tunnel apertures, materials of construction, and the method of producing the longitudinal seals are discretionary features that will depend on various factors such as the type of blasting to be performed, borehole size and environment, borehole loading technique, type of packaging film, type of manufacturing apparatus available, etc.

Suitable packaging films include those made from a polyester such as polyethylene terephthalate, nylon, and laminates of a polyester or nylon film sandwiched between two layers of low-density polyethylene. On the basis of strength and tear resistance, a preferred film is a cross-laminate of layers of oriented film, preferably a polyolefin such as polyethylene or polypropylene. Especially preferred is a currently available cross-laminate of two oriented high-density polyethylene films. Such a laminate can be made, for example, by uniting oriented films by the methods described in U.S. Pat. Nos. 3,322,613, 3,471,353, and 3,496,059, the plies, which consist of uniaxially oriented films, having directions of orientation that are inclined to one another. The oriented film can be an obliquely oriented band, made, for example, by the continuous method described in U.S. Pat. No. 2,943,356.

The means used to make the longitudinal seals can be any means that is convenient to use with the cartridge manufacturing method employed and that can provide seals of the required strength and tightness with the particular film used. Possible means of sealing include adhesive or solvent seals, beads of molten polymer, and heat seals, such as those made with heated rolls or bars or hot air jets. When the cartridge film is a biaxially oriented film of polymeric linear terephthalate, e.g., polyethylene terephthalate, which film cannot be effectively heat-sealed to itself, the seals can be made by the method described in U.S. Pat. No. 3,860,475, issued Jan. 14, 1975 to W. J. Simmons. The preferred cross-laminate of layers of oriented polyolefin film can be sealed by one or more adjacent linear beads of a molten polyolefin or copolymer thereof.

Figure 16:
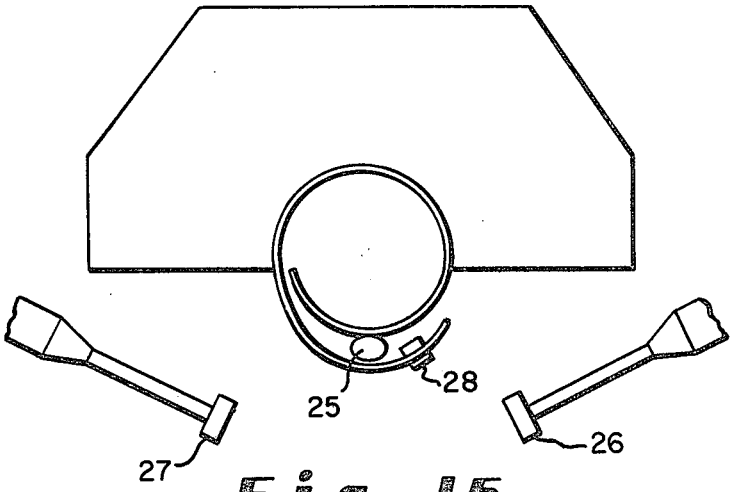
FIG. 16 is a schematic representation of a top view of a portion of the apparatus shown in FIG. 15.
Figure 15:
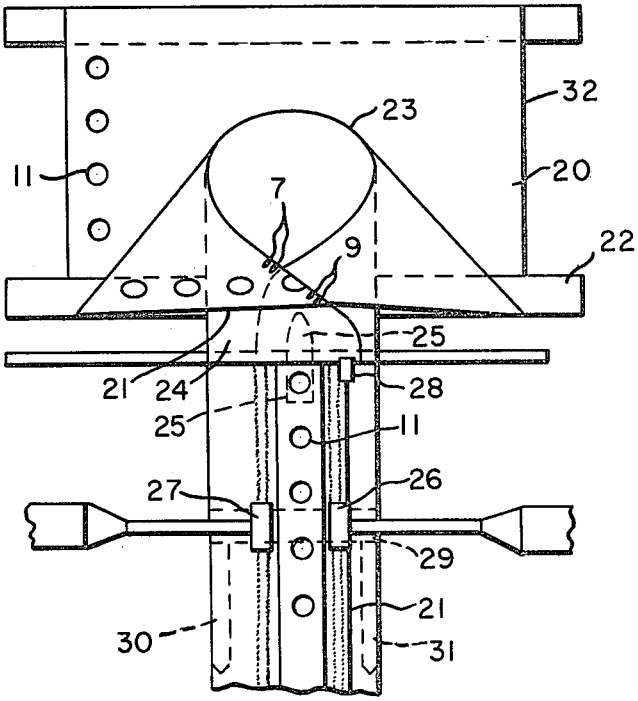
FIG. 15 is a schematic representation of a front view of a portion of an apparatus that preferably is used to carry out the method of the invention.

The preferred chub cartridges of the invention, shown in FIGS. 1, 2, and 3, can be made continuously in a series at high speed by the method of the invention by suitable modification of the type of apparatus described in U.S. Pat. No. 2,831,302, issued Apr. 22, 1958, to Oscar Mayer & Co. In the method of this invention, described with reference to FIGS. 15 and 16, a continuous web 20 of plastic film has a continuous row of holes 11 along one longitudinal edge. Web 20 is wrapped about a longitudinal axis so that the longitudinal edge 21 near holes 11 overlaps the other edge 32. This is accomplished by moving a continuous web 20 of film, e.g., a web of a cross-laminate of two oriented high-density polyethylene films 200 mm wide and 0.13 mm thick, from a supply roll (not shown), passing under guide bar or roller 22 and thence upwardly and over the upper curved edge 23 of convoluted cylindrical forming member 24 and down around a tubular filling mandrel (not shown). Holes 11 are 9.5 mm in diameter. The distance from their centers to edge 21 is 17.5 mm. The upper edge 23 of forming member 24 is shaped or cut away to cause web 20 to reverse its direction and to guide the longitudinal edges of web 20 downwardly into a tube-forming rotation around the filling mandrel. Finger 28 keeps web 20 from slipping out of forming member 24 along edge 21.

Forming member 24 has a "bullet" 25 attached to the inner overlapping section of the convolute between the two overlapping sections. As the film advances over and into forming member 24 around the filling mandrel, it is formed into a tube with overlapping longitudinal edges, holes 11 being present along the overlapping edge 21. "Bullet" 25 causes the overlapping section of film to move through a greater circumferential distance than the other section in the overlap region. Two adjacent beads of extruded molten polyethylene are applied continuously to the moving film at 7 and two at 9 as shown. Consequently, as the film moves through forming member 24, two adjacent continuous linear sealing beads are formed at 7 so as to result in a sealed tube 4 and an outer flap portion 8 containing holes 11, and two adjacent continuous linear sealing beads are formed at 9 so as to form an open tunnel adjacent to the tube, the exposed portion 8 of the tunnel containing the holes 11 in a longitudinal array, and this same portion being circumferentially longer than the inner wall portion 10 of the tunnel owing to the greater circumferential distance the overlapping section has moved through.

As the film moves through forming member 24, pressure wheels 26 and 27 apply pressure over the areas where sealing beads 7 and 9 are located to press the film against ring 29, which holds the film tube 4 in a desired diameter (51 mm) as the bead seals are formed. Ring 29 and rods 30 and 31 together form a sizing means for tube diameter control. Below pressure wheels 26 and 27, a means (not shown) is provided for cooling and thereby solidifying sealing beads 7 and 9.

A water-bearing blasting agent, e.g., one described in U.S. Pat. No. 3,431,155, issued Mar. 4, 1969, to C. Dunglinson and W. M. Lyerly, is fed into tube 4 through the filling mandrel, and the loaded tube and adjacent empty tunnel are jointly constricted, clipped (metal clips applied), and severed by well-known means.

The above-described procedure produces the cartridge shown in FIGS. 1 and 2. To produce the cartridge shown in FIG. 3, "bullet" 25 is affixed to the inside surface of the inner overlapping section of the convoluted forming member 24. This causes the inside section of the film in the overlap region to move through a greater circumferential distance than the outside section, and the inner wall portion of the tunnel to be circumferentially longer than the outer portion. A recess or groove is provided in sizing ring 29 to accommodate the larger inner wall portion.

The cartridge shown in FIGS. 4 and 5 can be made by folding the web of film 20 longitudinally, forming seal 9 to produce tunnel 10, and thereafter running the film through forming member 24 (this time "bullet" 25 being omitted) to form tube 4. To make the cartridge shown in FIG. 4, the row of holes 11 is set back from an edge of web 20 a sufficient distance to allow the fold to be made as shown in FIG. 4 to provide a tunnel of the desired size. After seal 9 has been made, the web of film with the pre-formed hole-containing tunnel is moved into forming member 24 with the fold line becoming edge 32, which is overlapped by edge 21 (in this case having no holes).

To make the cartridge shown in FIG. 5, the row of holes 11 is adjacent edge 21 as shown, and the web of film with the pre-formed hole-containing tunnel is moved into forming member 24 with the fold line becoming overlapping edge 21.

We claim:

1. A blasting cartridge of the chub type comprising a generally cylindrical body of plastic film gathered and closed at both ends and containing a water-bearing blasting agent, said generally cylindrical body comprising a web of film wrapped about a longitudinal axis and sealed continuously in the direction of said axis to form (a) a sealed, substantially tubular enclosure filled with said blasting agent, and (b) a flap portion, said flap portion being sealed longitudinally to form a tunnel adjacent to the substantially tubular enclosure on an axis parallel to the longitudinal axis of said enclosure, and said tunnel having a portion of its wall exposed to allow access to the tunnel without destroying the integrity of the tubular enclosure.

2. A blasting cartridge of claim 1 wherein said tunnel extends substantially the entire length of said cylindrical body.

3. A blasting cartridge of claim 2 wherein said tunnel is continuous.

4. A blasting cartridge of claim 3 wherein apertures are present in the exposed portion of the tunnel wall.

5. A blasting cartridge of claim 4 wherein said apertures are substantially circular holes.

6. A blasting cartridge of claim 4 wherein said tunnel has an exposed portion formed by said flap portion and an inner portion formed by the portion of the wall of said substantially tubular enclosure between the longitudinal seal that forms said enclosure and the longitudinal seal that joins said flap portion to said enclosure.

7. A blasting cartridge of claim 6 wherein said exposed portion of said tunnel is circumferentially longer than said inner portion.

8. A blasting cartridge of claim 6 wherein said inner portion of said tunnel is circumferentially longer than said exposed portion.

9. A blasting cartridge of claim 4 wherein said tunnel has an exposed portion and an inner portion formed by said flap portion in folded form.

10. A blasting cartridge of claim 4, 5, 6, or 7 wherein a row of more than two substantially equally spaced apertures is present in the exposed portion of the tunnel wall, the distance between the centers of said apertures being about from 25 to 76 mm.

11. A blasting cartridge of claim 1 wherein said film is a cross-laminate of oriented polyolefin films.

12. A primer assembly comprising (a) a blasting cartridge of the chub type comprising a generally cylindrical body of plastic film gathered and closed at both ends and containing a water-bearing blasting agent, said generally cylindrical body comprising a web of film wrapped about a longitudinal axis and sealed continuously in the direction of said axis to form (1) a substantially tubular enclosure filled with said blasting agent, and (2) a flap portion, said flap portion being sealed longitudinally to form a tunnel adjacent to the substantially tubular enclosure on an axis parallel to the longitudinal axis of said enclosure, said tunnel having a portion of its wall exposed to allow access to the tunnel without destroying the integrity of the tubular enclosure, and apertures being present in the exposed portion of the tunnel wall; and (b) an electric cap immersed in said blasting agent, the lead wires of said blasting cap emerging out of the tubular enclosure through a cap-insertion aperture in the wall thereof, lacing through the apertures in the tunnel wall, and emerging from one of said apertures for connection to an actuation means.

13. A primer assembly of claim 12 wherein said blasting cap is seated in a tubular booster made of cap-sensitive extruded plastic immersed in said blasting agent.

14. A primer assembly of claim 12 or 13 wherein said apertures are substantially equally spaced apart, extend substantially the entire length of said cartridge, and said lead wires are laced through said apertures and looped around said cartridge.

15. A blasting assembly comprising, in a borehole, a continuous column of chub cartridges of water-bearing blasting agent, the first cartridge in the hole being the cartridge in the primer assembly of claim 14, the primer assembly being positioned in the hole in a manner such that the bottom end of the blasting cap is directed toward the collar of the hole.

16. A primer assembly comprising (a) a blasting cartridge of the chub type comprising a generally cylindrical body of plastic film gathered and closed at both ends and containing a water-bearing blasting agent, said generally cylindrical body comprising a web of film wrapped about a longitudinal axis and sealed continuously in the direction of said axis to form (1) a substantially tubular enclosure filled with said blasting agent, and (2) a flap portion, said flap portion being sealed longitudinally to form a tunnel adjacent to the substantially tubular enclosure on an axis parallel to the longitudinal axis of said enclosure, said tunnel having a portion of its wall exposed to allow access to the tunnel without destroying the integrity of the tubular enclosure, and apertures being present in the exposed portion of the tunnel wall; and (b) a detonating cord threaded or laced through the apertures in the wall of said tunnel.

17. The primer assembly of claim 16 wherein said detonating cord is a low-energy detonating cord having one end in initiating relationship to an ignition charge in a nonelectric blasting cap immersed in said water-bearing blasting agent.

18. The primer assembly of claim 17 wherein said blasting cap is seated in a tubular booster made of cap-sensitive extruded plastic immersed in said blasting agent.

19. The primer assembly of claim 16 wherein said detonating cord is a low-energy detonating cord having one end in initiating relationship to an ignition charge in a nonelectric blasting cap, the blasting cap is seated in a tubular booster made of cap-sensitive extruded plastic, and said booster is seated in said tunnel.

20. A blasting assembly comprising, in a borehole, a continuous column of chub cartridges of water-bearing blasting agent, the first cartridge in the hole being the cartridge in the primer assembly of claim 17, 18, or 19, the primer assembly being positioned in the hole in a manner such that the bottom end of the blasting cap is directed toward the collar of the hole.

21. The primer assembly of claim 16 wherein said cord is a high-energy detonating cord, said cord being threaded through said tunnel so as to be held adjacent to the tubular enclosure for substantially the entire length of the cartridge between the tapered end portions thereof, one end of said cord being knotted to enable said cord to support the weight of the cartridge.

22. The primer assembly of claim 16 wherein said cord is a high-energy detonating cord, said cord being laced in and out of said tunnel through the apertures in the wall thereof and looped around the cartridge to enable said cord to support the weight of the cartridge.

23. A blasting assembly comprising, in a borehole, the primer assembly of claim 21 or 22 at the innermost end of the hole, the detonating cord in said primer assembly being threaded also through the aligned tunnels of a column of the cartridges of claim 4.

24. The primer assembly of claim 16 wherein said cord is a high-energy detonating cord, said cord being threaded also through the tunnels of two cartridges of claim 4 adjacent to said assembly.

25. A blasting assembly of claim 23 wherein said cartridges are spaced from one another.

26. A blasting assembly of claim 25 wherein ANFO is loaded in the space between cartridges.

* * * * *

UNITED STATES PATENT OFFICE

CERTIFICATE OF CORRECTION

PATENT NO. : 4,282,812

DATED : August 11, 1981

INVENTOR(S) : James Harvey Forgey; Donald Ray Stephens and Engnam Anthony Tan

It is certified that error appears in the above-identified patent and that said Letters Patent are hereby corrected as shown below:

Column 11, line 40, insert -- blasting -- before "cap".

Signed and Sealed this

*Seventeenth* Day of *August 1982*

[SEAL]

*Attest:*

GERALD J. MOSSINGHOFF

*Attesting Officer*

*Commissioner of Patents and Trademarks*